United States Patent [19]

Henricksen et al.

[11] Patent Number: 4,811,403

[45] Date of Patent: Mar. 7, 1989

[54] ULTRALIGHT LOUDSPEAKER ENCLOSURES

[75] Inventors: Clifford Henricksen, Buchanan, Mich.; John Lemon, Shipbottom, N.J.

[73] Assignee: U.S. Sound, Inc., Shipbottom, N.J.

[21] Appl. No.: 61,135

[22] Filed: Jun. 10, 1987

[51] Int. Cl.[4] ..... H04R 1/02

[52] U.S. Cl. ..... 381/87; 381/88; 381/159; 181/152

[58] Field of Search ..... 381/87, 88, 111, 153, 381/155, 159, 162, 164; 181/148, 150, 151, 152, 171, 179, 198, 199, 141, 145; 361/380, 381, 384, 386, 388, 389

[56] References Cited

U.S. PATENT DOCUMENTS

| | | | |
|---|---|---|---|
| 3,778,551 | 12/1973 | Grodinsky | 381/90 |
| 3,982,607 | 9/1976 | Evans | 181/151 |
| 3,991,286 | 11/1976 | Henricksen . | |
| 4,138,593 | 2/1979 | Hasselbach et a;/ . | |
| 4,210,778 | 7/1980 | Sakurai et al. . | |
| 4,449,579 | 5/1984 | Miyazaki et al. | 361/381 |

FOREIGN PATENT DOCUMENTS

| | | | |
|---|---|---|---|
| 2729343 | 1/1979 | Fed. Rep. of Germany | 381/87 |
| 54-153021 | 12/1979 | Japan | 381/87 |
| 57-127396 | 8/1982 | Japan | 381/159 |
| 0012498 | 1/1983 | Japan . | |
| 58-182991 | 10/1983 | Japan | 381/159 |

*Primary Examiner*—John W. Caldwell, Sr.
*Assistant Examiner*—Alvin Oberley
*Attorney, Agent, or Firm*—Steele, Gould & Fried

[57] ABSTRACT

A loudspeaker and enclosure assembly, comprising: a load bearing member exhibiting good thermal conductivity; at least one loudspeaker mounted on the load bearing member and in thermal engagement therewith; and, an enclosure having walls formed of rigid lightweight material mounted on the load bearing member to enclose the at least one loudspeaker, whereby the assembly is easily moved and mounted and thermal energy generated by operation of the loudspeaker is effectively dissipated through the load bearing member. The enclosure may be a rigid foam-filled member defining a generally funnel-shaped bore therein to form a horn for the loudspeaker, whereby a modular construction of interchangeable integrally formed enclosures and horns can be achieved.

20 Claims, 3 Drawing Sheets

ULTRALIGHT LOUDSPEAKER ENCLOSURES

BACKGROUND OF THE INVENTION

1. Field of the Invention

This invention relates generally to the field of loudspeaker enclosures and in particular, to light-weight, high-power thermally stabilized speakers.

2. Prior Art

High-power speakers as known in the art have a number of serious deficiencies, which stem from typical speaker construction. The problems are especially acute in those large speakers intended for use with portable, but high-powered sound systems, for example those used by bands and singers on tour. The term loudspeaker will be used herein to denote an electroacoustical component of a speaker, speakers including one or more loudspeakers, cross-over controls, and the like.

A typical speaker construction is illustrated in FIG. 1. A speaker 2 comprises a box-like enclosure 3 formed by six sides 4. Such a box is typically constructed from thirteen ply baltic birch plywood using heavy internal bracing, wood glue and an enormous quantity of wood screws. The box encloses one or more loudspeaker 6, each loudspeaker comprising a magnet assembly 8, an electromechanical driver/voice coil (not shown) and a horn 10. The magnet assembly (comprising magnetic and steel parts) 8 is very heavy, and a heavy-duty loudspeaker frame is usually required. Often, the horn forms part of the frame and is provided with a flange 12 by which the loudspeaker is affixed to what is thereby defined as the front panel of the speaker. The magnet assemblies 8 are typically the heaviest part of the loudspeaker, and the horn 10 and/or the frame must be of sufficient strength to support the magnet assembly. The box itself must be of sufficient strength not only to support the entire loudspeaker, but to support its own weight as well, through rigging fixtures or hardware 14. Such speakers, commonly referred to as "touring boxes", must be constructed by skilled cabinet makers, in order to assure that the speakers will withstand the rigors of transit and rigging. A consequence of operating high-powered loudspeakers is the generation of considerable thermal energy in and by the large and heavy magnet assemblies. The robust and closed construction of typical touring boxes results in very high ambient operating temperatures within the boxes. Operating temperatures within the box are normally on the order of approximately 150 degrees F.

The box must also perform an acoustical function, namely providing a rigid enclosure for the loudspeakers to enable efficient sound amplification and transmission. As a result, typical touring boxes weight in excess of two hundred fifty to four hundred pounds. Such touring boxes are not only expensive to manufacture and thermally inefficient to operate, but are extremely difficult to transport and rig.

No advances to speak of have been made in reducing the weight of the enclosure box, it being accepted by those skilled in the art that such heavy and robust construction is necessary to support the loudspeaker, although Japanese Patent No. 58-12498 is of some interest. However, there have been some efforts made to more efficiently dissipate thermal energy from loudspeakers and loudspeaker voice coils. Such efforts are exemplified by U.S. Pat. Nos. 3,991,286; 4,138,593; and, 4,210,778.

The above-noted Japanese patent discloses a speaker wherein the loudspeaker is supported by means of the magnet assembly, rather than the horn. This reduces the need for a heavy-duty loudspeaker frame. However, the reference does not disclose any heat transfer techniques and uses a conventional heavy-duty, heavy weight enclosure or box. Moreover, the injection molded plastic construction has very low strength. In the heat dissipation device for a loudspeaker voice coil disclosed in U.S. Pat. No. 3,991,286 the coil form for a loudspeaker voice coil is made of a material having high thermal conductivity. The coil form is attached to or integrally formed with a highly thermally conductive spider member which resiliently supports the coil form on the frame structure of the speaker, which also has high thermal conductivity. A heat sink member to facilitate the dissipation of the thermal energy is attached to the speaker frame structure. Construction of the speaker is otherwise conventional.

The moving voice coil loudspeaker with heat dissipating enclosure disclosed in U.S. Pat. No. 4,138,593 comprises the speaker housing or a surface portion thereof and/or the speaker sound panel or sound wall or certain surface portion thereof being formed by a material having a high thermal conductivity, the moving-coil unit of the loudspeaker being in thermally conductive engagement with the thermally conductive material. The construction is otherwise conventional. The loudspeaker system disclosed in U.S. Pat. No. 4,210,778 utilizes a heat pipe for conducting thermal energy from the loudspeaker, the heat pipe having a reflux port or other exit in a side of the enclosure for shedding the thermal energy. As with the other references, the construction of the box is fully conventional.

The inefficiencies of prior art touring boxes appear to stem from a firm belief by those skilled in the art that the enclosure must not only be sufficiently rigid to provide for proper acoustical response, but must be of sufficient strength to support not only its own weight, but the weight of the loudspeakers and any other equipment disposed therein or thereon. It is often desirable to place additional electronic amplifiers in close proximity to such speakers. A popular amplifier is the Carver Model PM 2.0 which develops 1000 watts of amplification and weighs only ten pounds. Despite its light weight, heat dissipation remains a serious problem. The invention taught herein overcomes all of the problems known with the prior art, by recognizing that the enclosure need in fact provide only one function, namely providing a rigid enclosure for the loudspeakers to assure proper acoustical response. This is accomplished by mounting one or more loudspeakers to a principal load-bearing member by means of the magnet assemblies of the loudspeakers, the load-bearing member exhibiting good thermal conductivity. Rigging or mounting of the loudspeaker and enclosure can be by attachment to the load-bearing member. The enclosure comprises walls formed of a rigid light-weight material which is also mounted on th load-bearing member, so as to enclose the one or more loudspeakers. The assembly is easily moved and mounted and thermal energy generated by operation of the loudspeakers is effectively dissipated through the load-bearing member. Overheating is avoided even when electronic amplifiers are also mounted in the speaker, as they can also be mounted on the load-bearing member, in thermal engagement therewith. The overall savings in weight can be as much as seventy percent, or more.

A number of advantages result form this design. In a conventional speaker, the wood box must be strong enought to support its own weight as well as the weight of all components mounted thereon and therein, by means of brackets or the like affixed to the sides thereof. The enclosure of a speaker recording to this invention need only be strong enough for acoustical purposes, that is, it need only be sufficiently strong or robust to be rigid. The enclosure of a speaker according to this invention has no load-bearing responsibility whatsoever, except for its own weight. A loudspeaker box according to conventional practice must do two jobs, acoustical response and component support. The enclosure of a speaker according to this invention need fulfill only an acoustical job. Most prior art speakers, notwithstanding those in the patent references discussed above, make no provision for heat transfer. Speakers according to this invention provide for full dissipation of excess thermal energy, including such additional components as amplifiers.

The very heavy weight of prior art speakers requires extra heavy-duty hanging hardware and extra heavy-duty speaker coverings. The very light weight of speakers according to this invention not only facilitates easy handling and transportion, but enables the use of light-weight hanging hardware and enables speakers to be more easily and conveniently stacked on one another. The lighter weight also enables use of lighter protective coverings, as there is less weight due to the speaker when impacted or impacting other objects. In fact, hanging hardware is not even strictly necessary, as speakers according to this invention are so light in weight as to enable full rigging by simply using cages or cargo nets. Speakers are usually suspended over the performers, or audience or both. Speakers according to this invention provide much higher safety margins against rigging failure.

Speaker enclosures made in accordance with the prior art require the skills and expense of experienced carpenters or cabinet makers, whereas speakers according to this invention may be assembled with simple tools and without the need for skilled craftsman.

Finally, prior art speakers require that components, particularly loudspeakers comprising magnet assemblies, electromechanical drivers and horns, must have supporting frames or be of sufficiently robust construction to be self-supporting. In speakers according to this invention, the loudspeaker assemblies can be affixed to the load-bearing member by means of the magnet assembly, which is the single heaviest part of the loudspeaker. No frames or particularly robust construction is otherwise required.

SUMMARY OF THE INVENTION

It is an object of this invention to provide a very light-weight, high-power speaker.

It is another object of this invention to provide a very low weight, high-power speaker which provides effective dissipation of all excess thermal energy generated during speaker operation.

It is yet another object of this invention to provide a light-weight, high-power speaker which can be easily constructed without carpentry skills.

It is yet another object of this invention to provide a light-weight, high-power speaker which can have auxiliary electronic components, for example electronic amplifiers, mounted therein or thereon.

It is yet another object of this invention to provide a light-weight, high-power speaker which is easy to transport and which does not require heavy-duty rigging.

It is yet another object of this invention to provide a high-power speaker which is safer to rig.

It is yet another object of this invention to provide a light-weight, high-power speaker which can be assembled from modular parts or subassemblies.

These and other objects of the invention are accomplished by a loud speaker and enclosure assembly, comprising: a load-bearing member exhibiting good thermal conductivity; at least one loudspeaker mounted on the load-bearing member and in thermal engagement therewith; and, an enclosure having walls formed of rigid light-weight material mounted on the load-bearing member to enclose the at least one loudspeaker, whereby the assembly is easily moved and mounted and thermal energy generated by operation of the loudspeaker is effectively dissipated through the load-bearing member. The load-bearing member may comprise means for enhancing thermal energy dissipation, for example at least one air channel formed in the load-bearing member and/or a fan for circulating air through the at least one air channel. Additional electronic equipment, for example an electric amplifier for the at least one loudspeaker, may also be mounted on the load-bearing member and in thermal engagement therewith, whereby thermal energy generated by the amplifier will also be effectively dissipated through the load-bearing member. Typically, the at least one loudspeaker comprises a magnet assembly, the loudspeaker being mounted on the load-bearing member by or through the magnet assembly. The loudspeaker and enclosure assembly may further comprise means forming an air seal between an exterior portion of the loudspeaker, for example the outlet port of the horn, and the enclosure, the air seal means being ineffective for transmitting load-bearing stress.

The load-bearing member and the enclosure may be so joined to one another that all or a portion of the load-bearing member is exposed exteriorly of the enclosure. In an alternative embodiment, the load-bearing member may be disposed entirely within the enclosure, in which case the assembly further comprises duct or vent means defining an air circulation path into the enclosure, through or over the load-bearing member and out of the enclosure for dissipating the excess thermal energy.

These and other objects of the invention are also accomplished by an integrated loudspeaker and enclosure assembly, comprising: at least one electro-acoustical driver having an acoustic output port; a rigid, light-weight, integrally formed member defining a generally funnel-shaped bore therein to form a horn for the electro-acoustical driver, the bore having acoustic input and output ports; and, means for holding the driver and the integrally formed member in rigid juxtaposition with the driver output port and the bore input port in operational engagement, whereby a modular construction of interchangeable integrally formed enclosure/horns and electro-acoustical drivers can be achieved. The means for holding the driver of the integrally formed enclosure/horn member in rigid juxtaposition may comprise a load-bearing member to which each of the driver and the enclosure/horn member are independently mounted. The load-bearing member may exhibit good thermal conductivity for dissipating thermal energy generated by the driver, the driver being mounted in thermal engagement with the load-bearing member. In each of the embodiments, the load-bearing member may comprise means for rigging the speaker assembly.

BRIEF DESCRIPTION OF THE DRAWINGS

For the purpose of illustrating the invention, there are shown in the drawings forms which are presently preferred; it being understood, however, that the invention is not limited to the precise arrangements and instrumentalities shown.

FIG. 7(*a*) is a diagrammatic view showing an alternative connection between the modules of the embodiment shown in FIG. 7; and, FIGS. 8(*a*), 8(*b*) and 8(*c*) illustrate the use of a material suitable for constructing the enclosures of the embodiments shown in FIGS. 2–7.

DETAILED DESCRIPTION OF THE PREFERRED EMBODIMENTS

Figure 1:
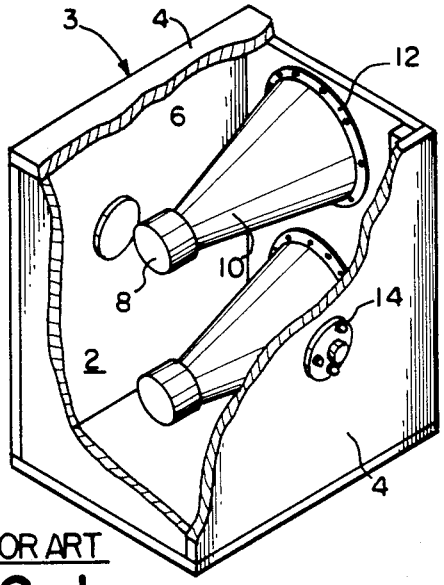
PRIOR ART FIG. 1
FIG. 1 is a perspective view, partially cut away, of a speaker constructed according to the prior art.

A number of different speakers according to this invention are shown in FIG. 2–7. Each of the embodiments shares a novel construction which, in each instance, ought to be compared to the prior art speaker construction shown in FIG. 1. Each speaker constructed in accordance with this invention is characterized by a single load-bearing member which is alternately referred to throughout the specification as a "backbone". The backbone is made from a material exhibiting good thermal conductivity, for example aluminum or relatively light weight but high strength steel alloys. Each speaker is also characterized by at least one loudspeaker, which for purposes of this description, is deemed to comprise a magnet assembly, an electro-acoustical driving means and a horn. An electro-acoustical driving means is often a voice coil which vibrates in an air gap with a magnetic field generated by the magnet assembly. Loudspeakers are most often constructed as cone loudspeakers or compression drivers, which may or may not be provided with throat extensions. The difference relates primarily to whether or not a diaphragm is mounted together with the voice coil for vibration therewith. This distinction is of no particular significance to this invention, as the invention may be embodied with either or both kinds of loudspeakers.

Irrespective of the type of loudspeaker, operation of such loudspeakers, particularly at high-power levels, causes very significant amounts of excess thermal energy to be generated. This energy is primarily conducted through the air gap to the magnet assembly. Such loudspeakers are accordingly mounted to the load-bearing member or backbone by means of securing the magnet assembly in thermal engagement with the load-bearing member or backbone, whereby excess thermal energy developed in the magnet assembly will tend to flow into the thermally conductive load-bearing member or backbone. The load-bearing member or backbone may be provided with passive or active means for dissipating thermal energy therefrom, which establishes a continuously acting means for substantially dissipating all excess thermal energy generated by the loudspeaker during operation.

Each of the embodiments is further characterized by a loudspeaker enclosure which is not manufactured from heavy plywood or the like, but is instead manufactured from a very light weight material, having a very high stiffness to weight ratio. One suitable material is a rigid foam core with taut metal skins bonded to each surface thereof, for example aluminum. Another suitable material is a plastic or cardboard core which is formed in an open cell or honeycomb arrangement, the walls of the cells running perpendicular to the taut skins. A suitable aluminum skin would be approximately 0.025 inches thick. A suitable skin may also be formed by laminated wood, approximately 0.25 inches thick. The specific construction is not critical, it being necessary only that the enclosure be rigid and that the enclosure be of sufficient strength to support its own weight. The thickness of the core layer will depend upon its inherent strength and rigidity. The enclosure, like one or more loudspeakers, is mounted on the load-bearing member or backbone, completely independently of the loudspeakers. Substantially no load-bearing stresses whatsoever are transmitted between the enclosure and the loudspeakers. As is apparent from the various illustrated embodiments in the drawings, the load-bearing member or backbone can be disposed so as to form a back wall of a speaker or can be disposed interiorly of the enclosure. Irrespective of the position of the backbone, it is the only load-bearing member for supporting the loudspeakers, the enclosure and the speaker itself for purposes of rigging the speaker. The various embodiments are also intended to illustrate the various passive and active means for enhancing heat dissipation by air circulation over, through and/or around the load-bearing member. It should be appreciated by those skilled in the art that the various passive and active air circulating means can be interchanged between various embodiments of the invention, including both those which are illustrated and those which are not illustrated, without departing from the patentable character of the invention.

The various embodiments of the invention illustrated in the drawings are also intended to demonstrate the modularity of construction which is possible when the mounting of the loudspeakers and the mounting of the enclosure are independent from one another, whereby a number of different enclosures can be used with the same load-bearing member and loudspeakers, whereby loudspeakers can be easily interchanged on a particular load-bearing member and whereby vents and conduits can be easily attached and detached depending upon whether the load-bearing member is placed interiorly or exteriorly of the enclosure. Those skilled in the art will appreciate that many, if not every one of the various features of the different embodiments of the invention shown in the drawings are interchangeable with one another with little or no modification.

Figure 2:
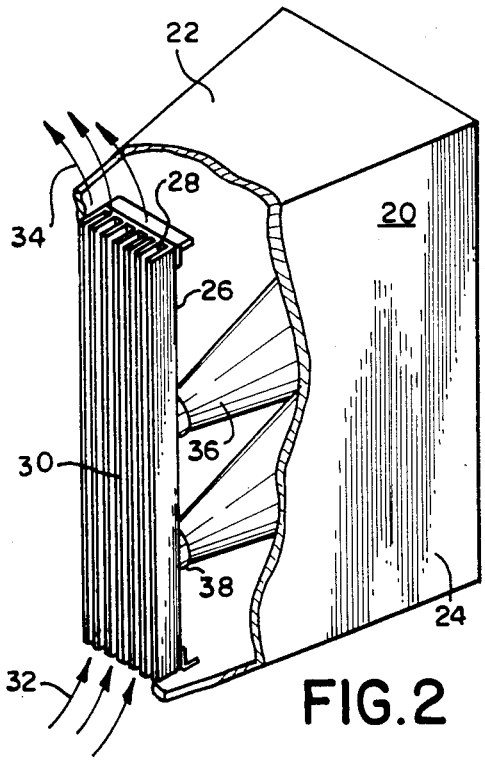
FIG. 2 is a rear perspective view of a speaker according to this invention, utilizing natural convection cooling.

A speaker 20 made in accordance with this invention is shown in FIG. 2 and comprises a backbone or load-bearing member 26, one or more loudspeakers 36 mounted on the load-bearing member and a loudspeaker enclosure mounted on the load-bearing member. The loudspeaker enclosure comprises a top 22, sides 24 and bottom (not shown). Each of the loudspeakers 36 includes a magnet assembly 38, by which the loudspeaker is affixed to the load-bearing member 26, being directly attachable thereto by bolts, brackets or the like. It is important that the magnet assembly be in substantial thermal engagement with the load-bearing member 26, and it may be appropriate to dispose a substance or material between the load-bearing member and the magnet assembly to enhance the thermal engagement, such substances and materials being well known, and not forming part of this invention in and of themselves. Such materials or substances are useful in obviating the need to machine a very smooth engagement surface on the magnet assembly to ensure sufficient thermal engagement with the smooth surface of the load-bearing member.

The load-bearing member or backbone 26 has a substantially squared-off U-shaped cross section, defining a recess or channel 28. A plurality of outwardly projecting fins 30 are disposed in the recess or channel 28 to enhance thermal radiation. During operation of the speaker, thermal energy generated in the magnet assembly will be transmitted to the backbone and the fins, and will be dissipated from the fins in such a way as to create an upwardly flowing air convection current, air entering the channel and flowing along and between the fins 30 at the location marked by arrows 32 and leaving the channel at the location marked by arrows 34. Depending upon the actual power of the loudspeakers and the thermal energy generated by operation thereof, such convectively assisted cooling may very well be adequate without additional means for providing forced circulation of air. A speaker 20 as shown in FIG. 2 can be rigged or hung or otherwise mounted in a number of ways, all of which are made possible by the ultra light weight construction. Mounting hardware of almost any variety and description can be affixed to the backbone or load-bearing member by appropriate screws, bolts or brackets and the speaker can be mounted to a vertical column or suspended from wires or suspended in a net or simply stacked one upon the other in a multiple array. It those instances where the backbone or load-bearing member is disposed interiorly of the enclosure, for example as in the embodiments of FIGS. 5 and 6, mounting hardware may extend or project through the enclosure. In either case, the speaker can be rigged with relatively light weight or light duty material, rather than the very heavy-duty rigging material and fixtures necessary to support a prior art speaker 2 as shown in FIG. 1. Alternatively, the continued use of heavy-duty rigging material provides an even greater safety margin.

Figure 3:
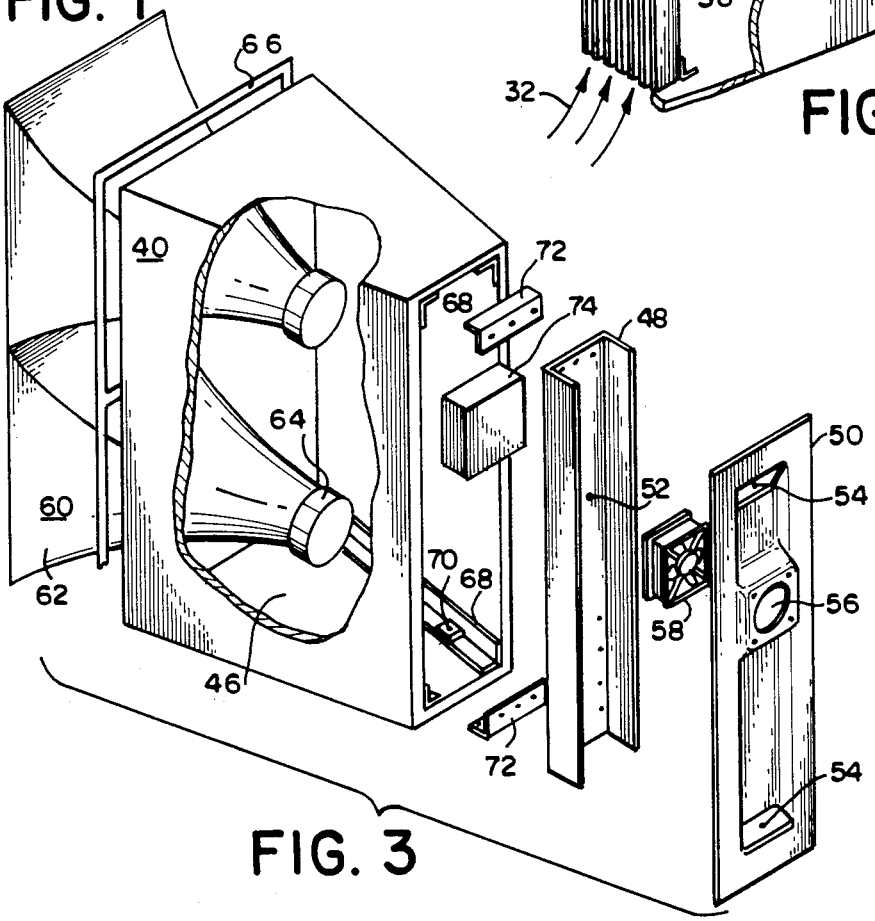
FIG. 3 is an exploded perspective view of another speaker according to this invention, utilizing positive air circulation means for cooling.

A typical construction for a speaker according to this invention is illustrated in exploded form in FIG. 3. A speaker 40 comprises a backbone or load-bearing member 48, one or more loudspeakers 60 and a rigid, light weight enclosure comprising top 42, sides 44 and bottom 46.

Each loudspeaker 60 comprises a magnet assembly 64, an electro-acoustical driver (not shown) and a horn 62. The open mouths of the horns 62 are designed to encompass the entire front of the speaker. Each of the loudspeakers 60 is directly mountable to the backbone or load-bearing member 48 by its respective magnet assembly 64, as in the embodiment of FIG. 2. A plurality of right angular brackets 68 are affixed along each interior corner of the enclosure, being held in place by glue, adhesive, nuts and bolts, rivets or any other suitable attachment means. Each of the right angular brackets 68 has a further bracket 70 glued, bolted, welded, riveted or otherwise attached thereto, which provides a means for receiving one of a further right angular bracket 72. The backbone or load-bearing member 48 may be affixed to the right angular bracket 72, by similar attachment means, whereby the enclosure may be easily, reliably and detachably secured directly to the load-bearing member, there being no load-bearing connection between any part of the enclosure and any parts of the loudspeakers 60. A sealing means, for example gasket 66, may be provided for sealing any gap between the rims of horn 62 and respective edges of the enclosure, as well as adjacent edges of the horns 62, to assure proper acoustical performance of the speaker. The backbone 48 is a square-edged, U-shaped member defining a channel or recess 52 therein. The channel or recess 52 is closed by a cover plate 50, which may be formed by a sheet metal stamping or the like. Cover plate 50 may be affixed directly to backbone 48 by screws or rivets, or may be affixed to the rear edge of the enclosure, that is, the back edges of top 42, sides 44 and bottom 46. In either event, recess or channel 52 is closed off.

Cover plate 50 is also provided with two air inlets 54 and a socket or bracket portion for receiving a fan 58 which includes an air outlet 56. Operation of fan 58 forces air to circulate through the channel 52, entering through inlets 54 and exiting through outlet 56. Such forced air circulation significantly enhances the dissipation of thermal energy.

It is often convenient and/or necessary to mount electronic amplifiers near, on or with speakers. This is usually difficult or impractical, as such amplifiers generate considerable excess thermal energy during operation, which cannot be effectively dissipated if such amplifiers are mounted interiorly of the speakers. Even where portions of such amplifiers are exposed, such amplifiers add to the temperature buildup. In speakers according to this invention, such amplifiers 74 can safely be mounted directly on the backbone or load-bearing member 48, and in thermal engagement therewith, just as the loudspeaker 60 and the enclosure, excess thermal energy being effectively dissipated through the load-bearing member together with excess thermal energy dissipated from operation of the loudspeakers.

It will be appreciated by those skilled in the art that speakers are often provided with electronic circuitry and controls to alter the frequency response or cross over characteristics between the various range loudspeakers which might be included in a single speaker. Controls are also provided for amplifiers and the like, which also may include circuitry for adjusting frequency response. Such circuitry, as well as conventional power cords and switches for fans and the like are omitted from the drawings for purposes of clarification and in any event, are and would be well understood by those skilled in the art.

Figure 4:
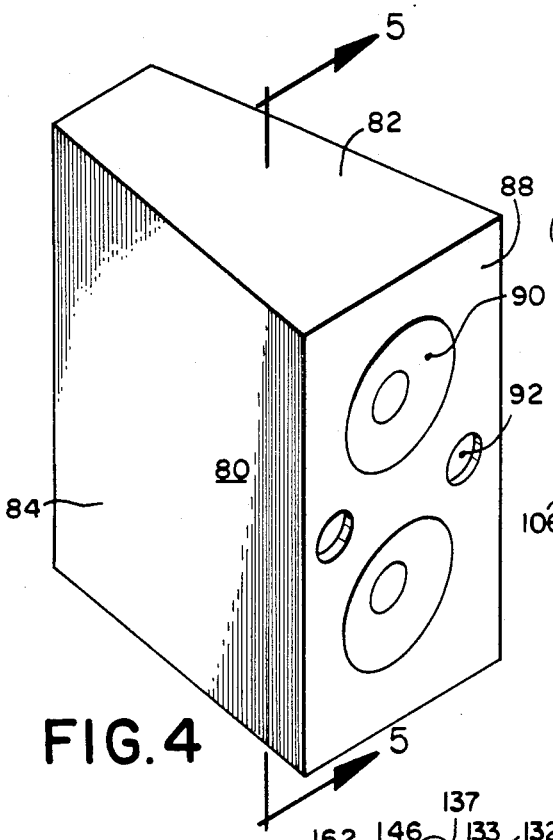
FIG. 4 is a font perspective view of another speaker according to this invention, utilizing an internal load-bearing member.
Figure 5:
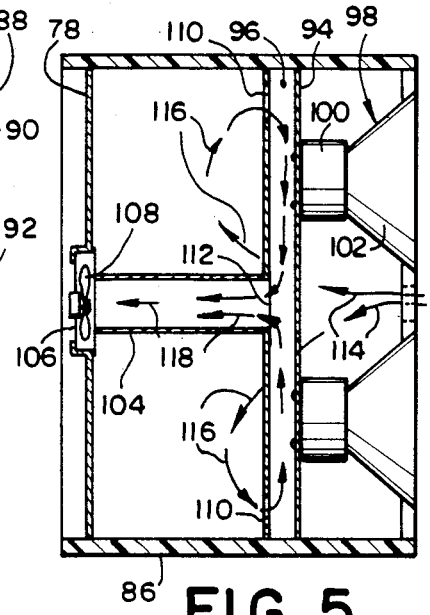
FIG. 5 is a section view taken along the line 5—5 in FIG. 4.

The speaker illustrated in FIGS. 4 and 5 is an appropriate construction for bass loudspeakers, and illustrates an interiorly mounted backbone or load bearing member. Such a speaker would be generally referred to by those skilled in the art as a vented bass box. The vents are used to tune the speaker to a certain frequency. The rented base box 80 comprises a backbone or load bearing member 96, two bass loudspeakers 98 mounted directly to the backbone and an enclosure, formed by top 82, sides 84, bottom 86 and back 78. The front 88 of the enclosure is formed with two apertures or openings 90, for receiving the horns 102 of the loudspeakers 98. Two vents 92, by which the base box is tuned, are also utilized as air inlets for the cooling system which is formed integrally with the speaker.

The backbone or load-bearing member 94 has a rectangular cross-section, and may be extruded as a single member or may be formed from one or more parts, as for example in the embodiment of FIG. 3. The hollow cross section defines a channel or recess 96. Backbone 94 is provided with air inlets 110 and air outlet 112. A fan 108 is mounted in an opening 106 in the back 78 of the enclosure. A pipe or conduit 104 is connected between outlet 112 and the fan 108. Operation of the fan establishes a forced air circulation path which enters the interior of the enclosure through the vents 92, indicated by the arrows 114, into inlets 110, indicated by arrows 116, along and through the channel or recess 96 to and through outlet 112, indicated by arrows 118, and then out of the enclosure through fan 108.

The speaker 80 may be provided with right angular brackets similar to bracket 68 as shown in the embodiment of FIG. 3, and may be provided with further brackets similar to brackets 70, which further brackets would be located more interiorly of the enclosure, to enable the backbone to be positioned as shown in FIG. 5. In the embodiment of FIG. 4 and 5, it would be necessary for mounting or rigging hardware to pass through the top and bottom 82 and 86, for direct or indirect attachment to the load-bearing member or backbone 94. This embodiment provides a particularly large amount of space within which to mount auxilliary electronic amplifiers to the side of the load-bearing member opposite the loudspeakers.

Figure 6:
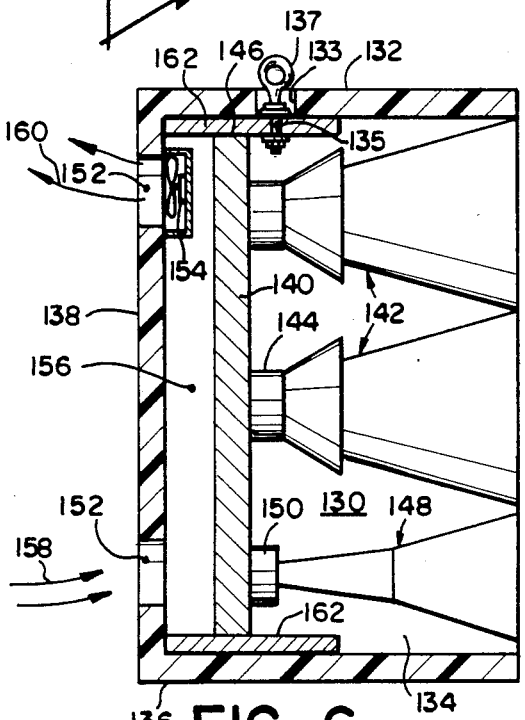
FIG. 6 is a section view through another speaker according to this invention.

The speaker 130 shown in FIG. 6 in cross-section illustrates yet another embodiment wherein different kinds of loudspeakers are employed, namely two woofers 142 and one tweeter 148. The woofers are mounted to a backbone or load-bearing member 146 by means of magnet assemblies 144 and the tweeter is mounted to the backbone by means of magnet assembly 150. The speaker enclosure comprises top 132, sides 134, bottom 136 and back 138. The enclosure is mounted to the backbone by means of brackets 162, in a manner analogous to that shown in FIG. 3. In this embodiment, the load-bearing member or backbone need not have a cross-section which defines all or part of a channel or recess, although it may have such a channel or recess or it may be provided with fins as in the embodiment of FIG. 3. In this instance, the rear wall 138 of the enclosure is provided with two openings or apertures 152, a fan 154 being mounted in interiorly of one or the other. Preferably, the fan 154 is mounted behind the opening 152 which will be uppermost during operation of the speaker. The rear wall 138 and backbone 140 define an air circulation zone 156, which, during operation of the fan, defines an air circulation path which enters through one of the openings 152, as shown by arrows 158, travels through the zone 156 and over along the backbone 140 and exits through the other opening 152, as shown by arrows 160.

Suitable rigging hardware is also illustrated in FIG. 6, wherein a direct connection to the backbone is not possible, as for example in the embodiments of FIGS. 1 and 2. The top 132 has a bore or opening 133 which aligns with an opening or bore 135 in bracket 162. An eyebolt 137 is directly bolted to bracket 162 with standard nuts, washers and/or lock washers. Alternatively, bore 135 may be threaded, whereby the eyebolt may be easily attached or removed without need to take apart the speaker. The speaker may be provided with one or more such eyebolts on one or both brackets 162. Hardware other than eyebolts may also be attached in similar fashion. The size of opening 133 is preferably smaller than the width of bracket 162 to ensure the integrity of the enclosure.

Figure 7:
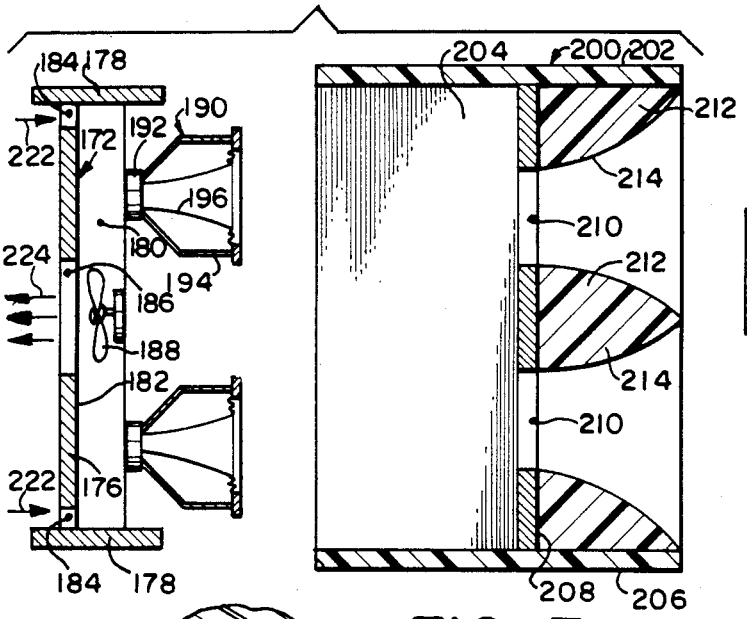
FIG. 7 is a section view, partially exploded, illustrating a modular embodiment of this invention.
Figure 7A:
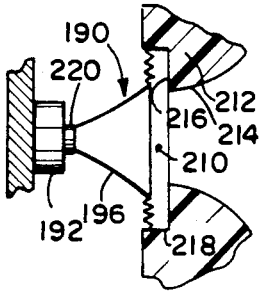

The speaker 170 shown in FIG. 7 illustrates the modular construction which is possible with a speaker according to this invention. The modular speaker 170 comprises an electro-acoustical driver module 172 and an enclosure module 200. The driver module 172 comprises a backbone or load bearing member 176, to which two loudspeakers 90 are affixed by means of magnet assemblies 192. Loudspeakers 190 are of the kind having a diaphram 196 which is mounted for movement together with a voice coil 220, the outer periphery of the diaphram being secured by a spider-type suspension 198 to the outer edge of a frame 194. It is only necessary that the frame 194 be as strong as is necessary to support the diaphram, not the magnet assembly 192 as would otherwise be the case.

The backbone 176 defines a recess or channel 180 which is closed by cover plate 182. Cover plate 182 is provided with air inlets or openings 184 and air outlet 186. A fan 188 is disposed in opening 186, to establish an air circulation path which enters the channel 180 through openings 184, as shown by arrows 222, and which flows through the channel 180, leaving through opening 186, as shown by arrows 224. Brackets 178 are attached to the backbone in order to provide means for attachment of the enclosure module 200.

The enclosure module 200 comprises a top 202, sides 204, bottom 206 and an interior partition 208. Interior partition 208 is provided with circular openings 210, which correspond in position and size to the outer perimeter of each diaphram 196. Interior portions of the enclosure module are filled with rigid foam, such as rigid urethane or other suitable material which is covered with a taut or otherwise rigid skin 214, for example aluminum or the like. The foam 212 is so shaped as to form extension horns for the loudspeakers. Inasmuch as there is substantially only abutting engagement between the frame 194 and the partition 208, it will be appreciated that driver modules and enclosure modules can be interchangeably connected to one another, provided that the sizes of the diaphrams and circular openings 210 correspond with one another.

An alternative embodiment to that shown in FIG. 7 is shown diagrammatically in FIG. 7(*a*), wherein the partition 208 is formed with an annular notch 216 around each opening 210, which defines an annular attachment rim 218 for affixing the spider suspension 198 of each diaphram 196. This embodiment is otherwise the same as that shown in FIG. 7, but obviates the need even for a light weight frame 194.

Figure 8C:
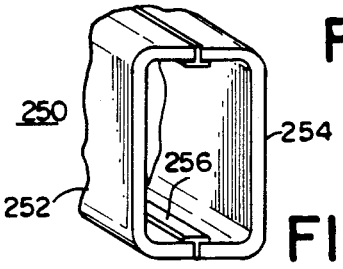
Figure 8A:
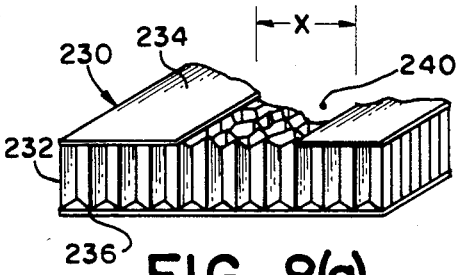
Figure 8B:
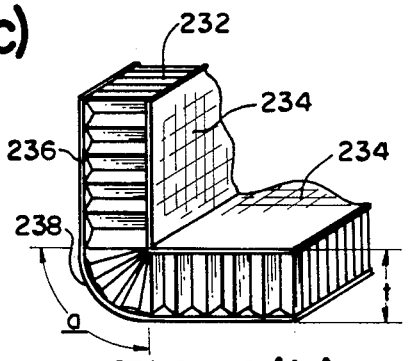

Certain aspects of enclosure construction are shown in FIGS. 8(*a*), 8(*b*), and 8(*c*). A section of enclosure material 230 comprises a honeycomb core 232 covered by an upper skin 234 and a lower skin 236. A right angle can be formed as shown in FIG. 8(*b*) by cutting away a portion of the skin 234 as shown in FIG. 8(*a*), the uncovered portion 240 having a length x. A bend can be formed which compresses the portion of honeycomb core adjacent to the interior of the angle. The right angular portions can be adhesively bonded to one another. The distance x, the bending angle a and the thickness t of the material 230 are related to one another by the formula $\times = 2\pi ta/360$. It will be appreciated by those skilled in the art that speaker enclosures can be formed by cutting out patterns from flat stock and folding and adhesively bonding into the desired shape, not unlike cardboard cartons. An alternative construction is shown in FIG. 8(*c*), wherein each enclosure 250 is formed from two halves 252 and 254. The halves are joined to T-shaped brackets 256, and thereby to one another, by adhesive bonding, rivets, nuts and bolts or other suitable attachment means. A backbone or load-bearing member can be affixed to the brackets 256, reducing the number of brackets needed for construction, for example with respect to the embodiment shown in FIG. 3.

This invention may be embodied in other specific forms without departing from the spirit or essential attributes thereof. Accordingly, reference should be made to the appended claims, rather than to the foregoing specification, as indicating the scope of the invention.

We claim:

1. A loudspeaker and enclosure assembly, comprising:

a thermally conductive load bearing member forming a heat dissipator for the assembly;

at least one loudspeaker mounted on the thermally conductive load bearing member, in thermal engagement therewith; and, an enclosure having walls formed of rigid lightweight material mounted on the load bearing member to enclose the at least one loudspeaker, whereby the assembly is easily moved and mounted, mounting loads of the at least one loudspeaker and the enclosure are borne substantially entirely by the load bearing member and thermal energy generated by operation of the at least one loudspeaker is effectively dissipated through the thermally conductive load bearing member.

2. The assembly of claim 1, wherein the load bearing member comprises means for enhancing thermal energy dissipation.

3. The assembly of claim 2, wherein the means for enhancing thermal energy dissipation comprises at least one air channel formed in the load bearing member.

4. The assembly of claim 2, wherein the means for enhancing thermal energy dissipation comprises a fan.

5. The assembly of claim 3, wherein the means for enhancing thermal energy dissipation comprises a fan for circulating air through the at least one air channel.

6. The assembly of claim 1, further comprising an electric amplifier for the at least one loudspeaker, mounted on the load bearing member and in thermal engagement therewith, whereby further thermal energy generated by the amplifier is effectively conducted away from the amplifier through the load-bearing member and dissipated therefrom together with the thermal energy generated by the at least one loudspeaker.

7. The assembly of claim 1, wherein the at least one loudspeaker comprises a magnet assembly, the loudspeaker being mounted on the load bearing member by the magnet assembly.

8. the assembly of claim 1, further comprising means forming an air seal between an exterior portion of the at least one loudspeaker and the enclosure, the air seal means being ineffective for transmitting load bearing stress.

9. The assembly of claim 1, wherein the enclosure is a rigid foam-filled member defining a generally funnel-shaped bore therein to form a horn for the at least one loudspeaker, whereby a modular construction of interchangeable integrally formed enclosures and horns is achieved.

10. The assembly of claim 1, wherein the load bearing member comprises means for rigging the assembly.

11. The assembly of claim 1, comprising a plurality of loudspeakers mounted on the load bearing member and enclosed by the enclosure, whereby thermal energy generated by operation of all of the loudspeakers is effectively dissipated through the load bearing member.

12. The assembly of claim 11, further comprising at least one electric amplifier for the plurality of loudspeakers, mounted on the load bearing member and in thermal engagement therewith, whereby further thermal energy generated by the at least one amplifier is also effectively conducted away from the at least one amplifier through the load bearing member and dissipated therefrom together with the thermal energy generated by the plurality of loudspeakers.

13. The assembly of claim 12, further comprising means for enhancing radiation of thermal energy from the load bearing member to ambient air.

14. The assembly of claim 13, wherein the means for enhancing thermal radiation comprises:

the load bearing member being formed with at least one air channel running at least partially therethrough; and, fan means for circulating air through the at least one channel.

15. An integrated electro-acoustical driver and enclosure assembly, comprising:

at least one electro-acoustical driver having an electrical signal input and an acoustic driver output port;

a rigid solid foam horn/enclosure member defining a generally funnel-shaped bore therein to form a horn for the at least one electro-acoustical driver, the bore defining an acoustic horn input port and an acoustic horn output port; and, thermally conductive means for holding the at least one electro-acoustical driver and the foam member in rigid juxaposition with the acoustic driver output port of the at least one electro-acoustical driver and the acoustic horn input port of the foam member in operational engagement with one another, mounting loads of the at least one electro-acoustical driver and the enclosure being borne substantially entirely by the holding means and thermal energy generated by the at least one electro-acoustical driver being dissipated by the holding means, whereby a modular construction of interchangeable integrally formed enclosure/horn members and electro-acoustical drivers is achieved.

16. The assembly of claim 15, further comprising air seal means disposed between the at least one driver and the foam member.

17. The assembly of claim 15, wherein the means for holding the at least one driver and the foam member in rigid juxaposition comprises a load bearing member to which each of the at least one driver and the foam member are independently mounted.

18. The assembly of claim 17, wherein the load bearing member is a thermally conductive member forming a heat dissipator for the assembly and the at least one driver is mounted in thermal engagement with the load bearing member.

19. The assembly of claim 17, wherein the load bearing member is disposed substantially outside of the foam block.

20. The assembly of claim 17, wherein the load bearing member comprises means for rigging the assembly.

* * * * *